US008317430B2

(12) United States Patent
Yan

(10) Patent No.: US 8,317,430 B2
(45) Date of Patent: Nov. 27, 2012

(54) CRAWLER-TYPE AND HEIGHT ADJUSTMENT DRILLING MACHINE FOR SETTING ROOF AND SIDE WALL ANCHOR BOLTS AND ANCHOR CABLES

(76) Inventor: Zhendong Yan, Jincheng (CN)

( * ) Notice: Subject to any disclaimer, the term of this patent is extended or adjusted under 35 U.S.C. 154(b) by 425 days.

(21) Appl. No.: 12/532,783

(22) PCT Filed: Sep. 28, 2008

(86) PCT No.: PCT/CN2008/001665

§ 371 (c)(1),
(2), (4) Date: Sep. 23, 2009

(87) PCT Pub. No.: WO2009/043234

PCT Pub. Date: Apr. 9, 2009

(65) Prior Publication Data

US 2010/0119310 A1 May 13, 2010

(30) Foreign Application Priority Data

Oct. 1, 2007 (CN) ..... 2007 2 0102731 U

(51) Int. Cl.
*E21D 20/00* (2006.01)

(52) U.S. Cl. ..... 405/259.1; 405/291; 173/185

(58) Field of Classification Search ..... 405/259.1, 405/259.5, 259.6, 291, 299; 175/184, 185, 175/31

See application file for complete search history.

(56) References Cited

U.S. PATENT DOCUMENTS

| | | | | |
|---|---|---|---|---|
| 2,799,249 | A * | 7/1957 | Lear | 91/44 |
| 3,842,610 | A * | 10/1974 | Willis et al. | 405/302.1 |
| 3,913,338 | A * | 10/1975 | Galis | 405/303 |
| 3,967,686 | A * | 7/1976 | Fogelstrom | 173/184 |
| 4,158,520 | A * | 6/1979 | Prebensen | 405/259.1 |
| 4,284,368 | A * | 8/1981 | Albright | 405/291 |
| 6,109,700 | A * | 8/2000 | Branson et al. | 299/33 |
| 6,736,225 | B2 * | 5/2004 | Pierce | 175/58 |
| 6,981,559 | B2 * | 1/2006 | Rubie et al. | 173/184 |

FOREIGN PATENT DOCUMENTS

| | | | |
|---|---|---|---|
| CN | 1584292 | A | 2/2005 |
| CN | 2679337 | Y | 2/2005 |
| CN | 2735002 | Y | 10/2005 |
| CN | 2735003 | A | 10/2005 |
| CN | 2758433 | Y | 2/2006 |
| CN | 2816322 | Y | 9/2006 |
| CN | 201169036 | A | 4/2008 |
| CN | 201106451 | Y | 8/2008 |

* cited by examiner

*Primary Examiner* — Tara Mayo-Pinnock

(74) *Attorney, Agent, or Firm* — Pedersen and Company, PLLC; Ken J. Pedersen; Barbara S. Pedersen

(57) ABSTRACT

A crawler-type and height adjustable drilling machine includes a crawler moving part, a temporary support, a lift cylinder, a cross beam, a roof anchor drill for setting roof anchor bolts and cables which that can turn left or right around 30°, a side-wall-anchor drill for setting side wall anchor bolts and cables that can turn toward one side around 90°, a platform for the drills, a hydraulic system and operation console, and a crawler driving motor. A coal pushing shovel is in front of the crawler moving part and below the platform. Double columns are provided on which a slipway is mounted for left and right moving of the roof anchor drill. The platform is also provided with a forward and backward slipways on which the side-wall-anchor drill is arranged so that a cylinder mounted on the platform pushes the side-wall-anchor drill forward and backward.

20 Claims, 4 Drawing Sheets

CRAWLER-TYPE AND HEIGHT ADJUSTMENT DRILLING MACHINE FOR SETTING ROOF AND SIDE WALL ANCHOR BOLTS AND ANCHOR CABLES

CROSS REFERENCE

This application is a 371 U.S. National Entry Application of PCT/CN2008/001665, international filing date Sep. 27, 2008, and this application claims priority of a Chinese patent application with the application number of 200720102731.2, filed Oct. 1, 2007, of which all the contents are cooperated herein by reference.

TECHNICAL FIELD

The present invention refers to an excavating equipment in a coal mine shaft, especially a machine for setting roof and side wall anchor bolts and anchor cables, which is suitable for continuous mining, continuous excavating and comprehensive excavating.

BACKGROUND OF THE INVENTION

At present, various ways of excavating coal mine tunnels include mainly continuous mining, continuous excavating and comprehensive excavating; the supporting ways is the combined supporting of anchor bolts, anchor cables, trimming beams and anchor nets. During etting of roof anchor bolts and anchor cables mono-drills or a crawler-type drilling machines are used. For example, a self-propelled roof bolter which is disclosed in a Chinese patent No. 200420091861.7 comprises two drilling devices, two advanced supports, a crawler-type moving mechanism, a slipway for the integral horizontal movement of the drilling devices and a platform, wherein the moving mechanism is driven by a hydraulic motor and is provided on the rack thereof with an anchor bolter platform equipped with two hydraulic cylinder type advanced supports on both sides at the front end of the platform, two gantry drilling devices following the two hydraulic cylinder type advanced supports, a slipway for the horizontal movement of the whole drilling devices which are arranged on the slipway, an electric control cabinet, a hydraulic pumping unit and a material box and the like. Each drilling device comprises a pillar, a device for horizontal movement of the gantry, a gantry-rotating device, an oil cylinder for forward and backward swinging of the gantry, a trunnion, the gantry and a drilling motor unit mounted on the gantry which in turn by means of the trunnion and the cylinder for swinging forward and backward of the gantry is articulated on the gantry-rotating device mounted on the device for horizontal movement of the gantry which is fixed on the pillar arranged on the slipway for the integral horizontal movement.

Hand-held pneumatic drills are used both in setting of Side wall anchor bolts and Side wall anchor cables which has the following problems:

(1) The excavated tunnel has a small cross section: about 15 $M^2$ generally, and a scaffolding is needed for setting roof and/or Side wall anchor bolts and anchor cables if the height of the tunnel is over 2 m.

(2) The operation can not be mechanized: setting of roof anchor bolts and anchor cables in the mining tunnels has been substantially mechanized in the process of continuous mining and continuous excavating, but has still been manually operated by means of the mono-drill in the process of comprehensive excavating, however for setting of Side wall anchor bolts and anchor cables in whatever mining or excavating process man still uses hand-held pneumatic drill, in which the push force for drilling hole comes from the arms of workers, which results strong labor work and un-ensured quality of the setting of the side walls anchor bolts and anchor cables.

(3) The setting speed is slow: plenty of time is needed for setting and the dismounting of the scaffoldings when the cross section is over 2 m.

(4) The efficiency is low: due to too many drilled holes and too many labors.

(5) The safety is difficult to control: due to the operation at high altitude and the poor environment.

SUMMARY OF THE INVENTION

The invention aims at solving the above problems in setting top and side wall anchor bolts and anchor cables in the excavating tunnels of the coal mine by providing a crawler-type and height adjustable drilling machine for setting roof and side wall anchor bolts and anchor cables, which improves the rate of advance and the working efficiency, reduces the labor intensity and workers, provides safe operation environment, has the functions of self-moving, height adjustable, simultaneous setting top and Side wall anchor bolts and anchor cables, temporally supporting and super-high tunnel supporting and the like through a full hydraulic transmission system, and has good explosion-proof and safety performance.

The present invention provides a crawler-type and height adjustable drilling machine for setting roof and side wall anchor bolts and anchor cables which comprises a crawler moving part, a temporary support, a lift cylinder, a cross beam, a hydraulic drilling for roof anchor bolts and anchor cables, a drilling for side wall anchor bolts and anchor cables, a platform for the drills, a hydraulic system and operation console, a crawler driving motor and a slipway used for forward and backward movement of the drill for side wall anchor bolts and anchor cables, wherein a coal pushing shovel is arranged in front of the crawler moving part and below the platform for the drills; the hydraulic drill for top anchor bolts and anchor cables is arranged at the front part of the platform for the drills and rotatable to the left or right by means of the slipway for the left and the right movable part mounted on double-column; the hydraulic drill for the side wall anchor bolts and anchor cables is arranged at one side wall to the central part of the platform for the drills, either tending left side wall or right side wall and also rotatable toward the left or right; the platform for the drills is provided with the slipways for moving forwardly and backwardly, on which the columns of the hydraulic drill are arranged so that the cylinder mounted on the platform for the drills pushes the whole drill to move forwardly and backwardly.

In one of the double columns are arranged the temporary support and the lift cylinder which connects the cross beam on its top.

Compared with the prior art, the crawler-type and height adjustable drilling machine for securing roof and/or side wall anchor bolts and anchor cables according to the present invention has the following substantive characteristics and significant technical progress:

(1) Drilling faster; excavating in larger and various shaped cross sections; high recovery rate of resources; safer, more reliable; more compact and lighter; and the high adaptability. The problems of low footage and small section in the prior art of continuous mining, continuous excavating and combined excavating have been solved. The drilling machine has multifunctions, that is self-moving, lifting, simultaneous setting the roof and side wall anchor bolts and anchor cables and temporally supporting and super-high tunnel supporting and the like, adopts a full hydraulic system for transmission and has good explosion proof and safety performance.

(2) Innovation achieved in the filed of continuous mining, continuous excavating and comprehensive excavating which leads the setting of anchor bolts and anchor cables of the side wall mechanized and significantly improves the rate of advance.

(3) Simultaneously setting the anchor bolts and the anchor cables on the roof and side walls, with the side wall anchor bolts arranged behind the roof anchor bolts by a distance less than 1 m, which is benefit to the excavating of soft coal layer due to the possibility of effective controlling side wall falling and preventing roof accidents.

(4) Especially suitable for comprehensive excavating of a single tunnel wherein, the crawler-type and height adjustable drilling machine is stopped at one side wall of the single tunnel where it does not disturb coal cutting of a mechanical tunneling machine, which return to a position under the permanent support after cutting and followed by moving of the crawler-type and height adjustable drilling machine into a space under the roof for support.

(5) Improving the process of continuous mining and continuous excavating in double tunnels or three tunnels in the prior art by substituting operation of a continuous mining machine, a large-power excavator and a bolter in turn for alternation operation, which reduces the time when the apparatus disturb each other and therefore increase the advancing speed.

(6) Possible of moving left and/or right, while freely up and down along the vertical direction, and moving forward and backward while freely up and down along the vertical direction and turning, which means a good maneuverability and very convenient to operate.

(7) High safe coefficient, capable of effective temporary support of a roof plate before setting of the bolt and the anchor cable support even in the top-caving area.

(8) Less labor and high efficiency, only four workers for setting of side wall anchor bolts and anchor cables with the crawler-type and height adjustable drilling machine, much less than setting the side wall anchor bolts and anchor cables with hand-held pneumatic drills in which each drill needs two persons and at least 12 persons for building.

In general, the crawler-type and height adjustable drilling machine for securing roof and side wall anchor bolts and anchor cables according to the present invention have improved capability of excavating under the coal mine shaft.

DETAILED DESCRIPTION OF THE EMBODIMENTS

Figure 1:
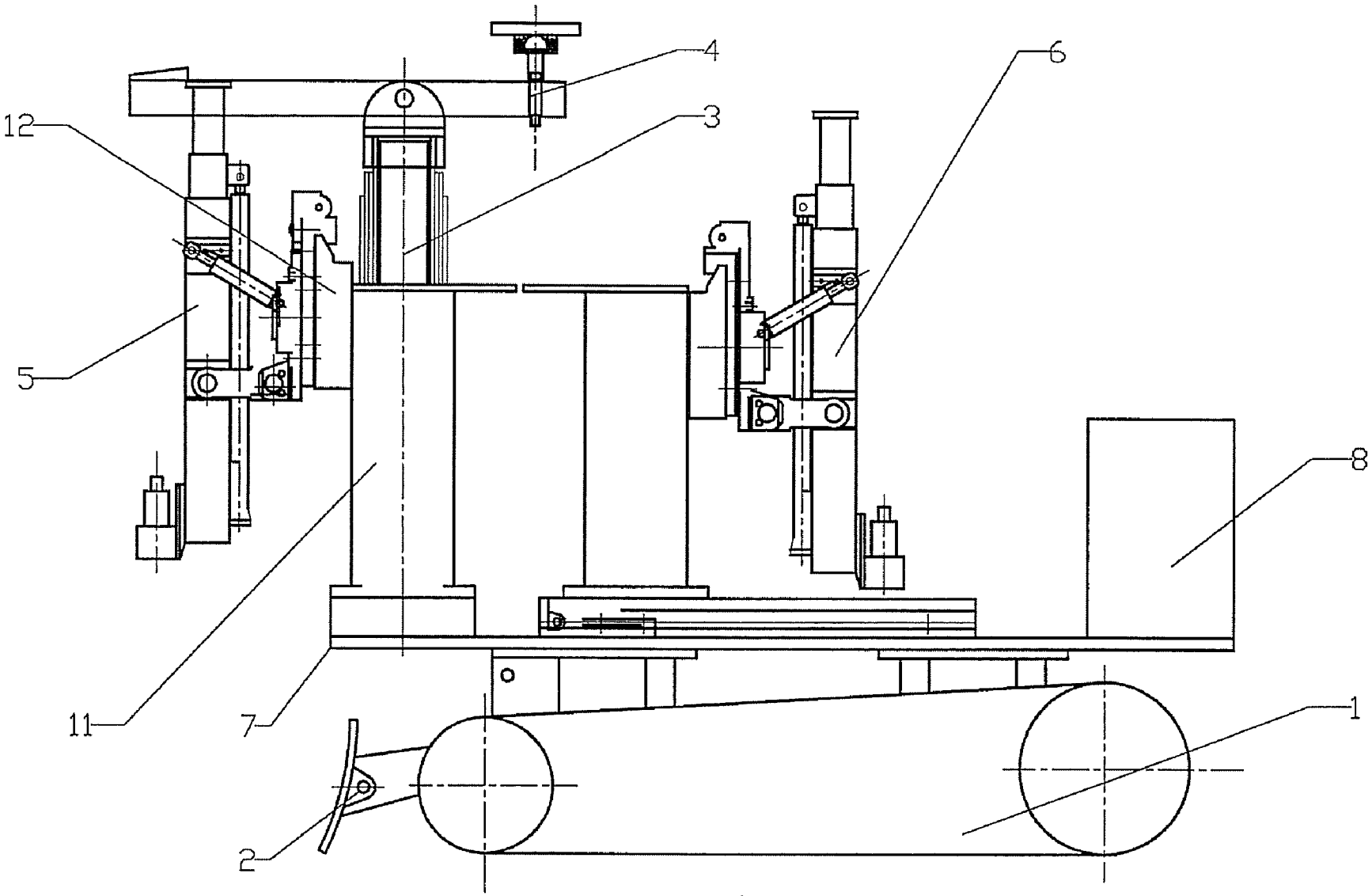
FIG. 1 is a front view of a preferred embodiment of the crawler-type and height adjustable drilling machine for setting roof and/or side wall anchor bolts and anchor cables according to the present invention.

Now the present invention will be described in detail and by reference of preferred embodiments shown in the drawings.

Figure 2:
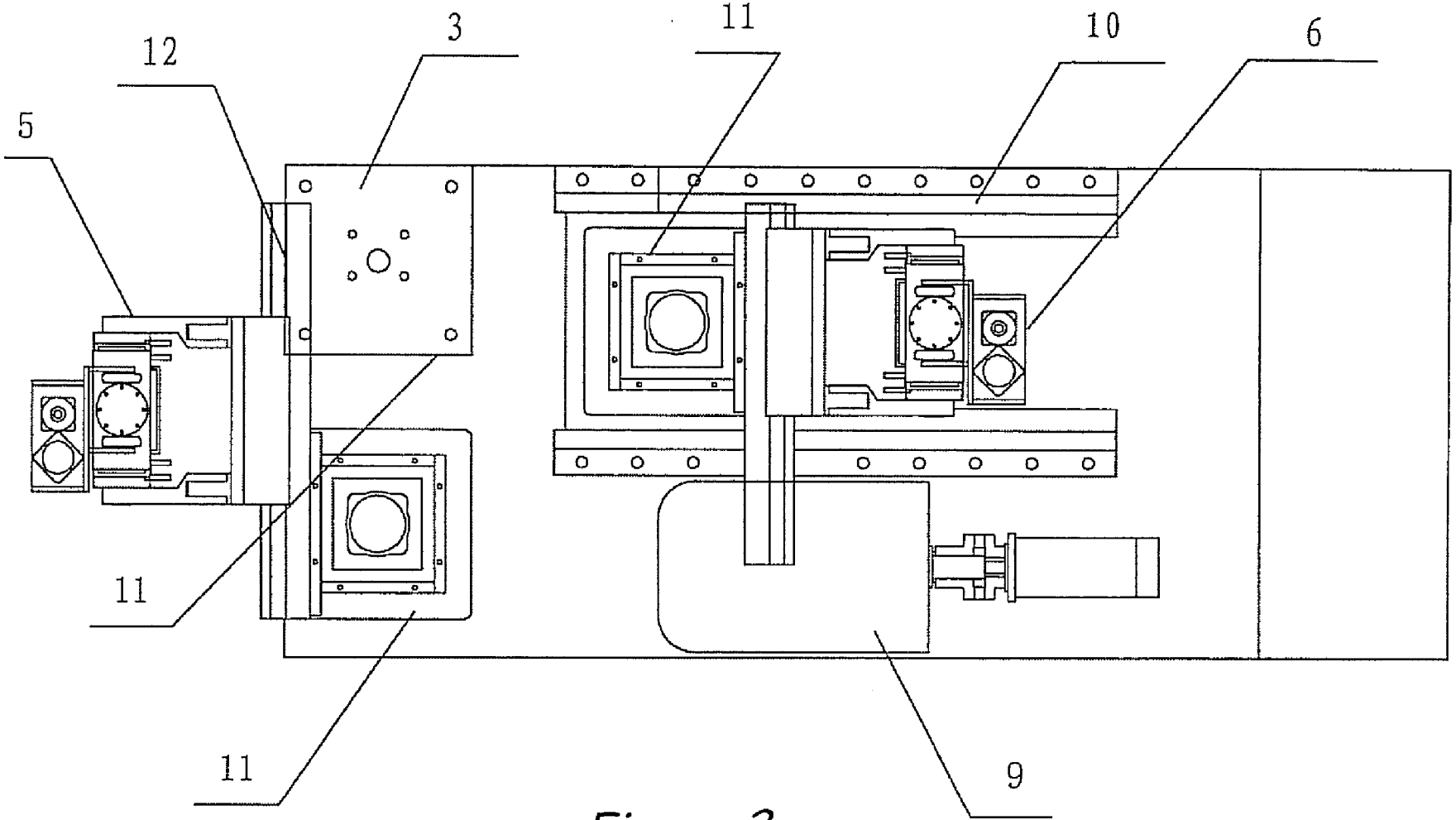
FIG. 2 is a top view of the crawler-type and height adjustable drilling machine shown in FIG. 2.
Figure 3:
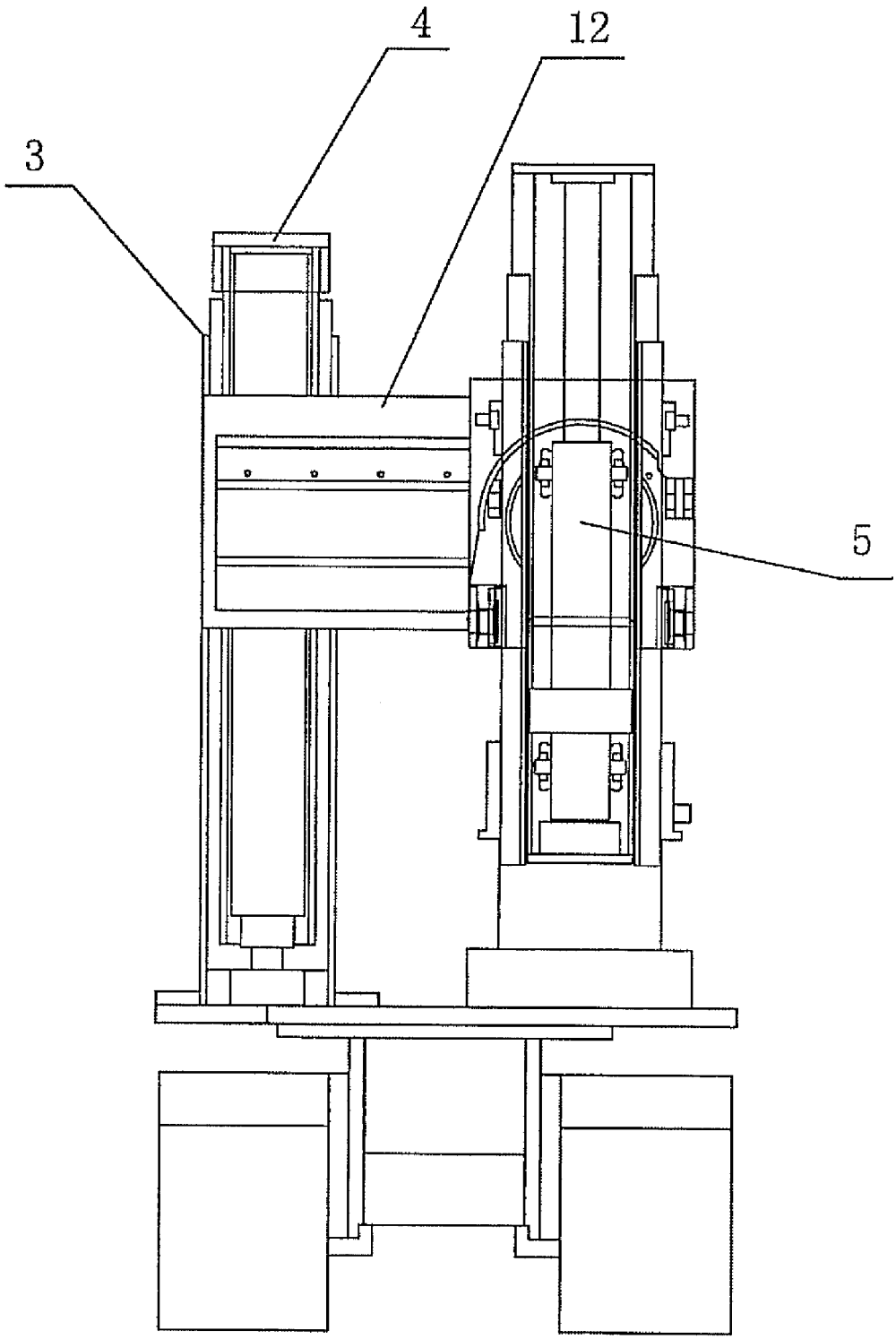
FIG. 3 is a left view of the crawler-type and height adjustable drilling machine shown in FIG. 1.

As shown in the FIGS. 1, 2 and 3, the crawler-type and height adjustable drilling machine for securing roof and/or side wall anchor bolts and anchor cables of the invention comprises a crawler moving part 1, a coal pushing shovel 2, a temporary support 3, a cross beam 4, a hydraulic drill 5 used for construction of anchor bolts and anchor cables of the top, a drill 6 used for construction of anchor bolts and anchor cables of the side wall, a platform 7 for the drills, an hydraulic system and operating console 8, a crawler-type driving motor 9 and a slipway 10 for forward and backward movement of the drill for side wall anchor bolts and anchor cables. The crawler-type and height adjustable drilling machine according to the present invention adopts is equipped with double columns 11 on which a slipway 12 for left and/or right moving is arranged.

In the crawler-type and height adjustable drilling machine for setting roof and side wall anchor bolts and anchor cables, the hydraulic system, the hydraulic operating console for hydraulic drill, the crawler moving part, the drill parts and the rotating part of the drill for side wall anchor bolts and anchor cables and the like are all ones in the prior art. For example, the crawler moving parts, such as a track frame, a bottom frame beam and a hydraulic power transmission system and the like are the same as in the general engineering machinery. The present invention improved the structure thereof and optimized the combination and integration on the arrangement.

The coal pushing shovel 2 is arranged at the front part of the crawler moving part and under the platform 7 for the drills, in front of which is the hydraulic drill 5 for setting roof anchor bolts and anchor cables which can move toward left and/or right and/or turn left and/or right, for example, by 30 degrees, which is convenient for setting corner anchor bolts. The hydraulic drill 6 for side wall anchor bolts and anchor cables arranged on the platform for the drills, deviating from the central line of the platform to the left side or the right side can move forward and backward and/or turn left or right, for example by 90 degrees (only in one direction), which is convenient for setting the side wall anchor bolts and anchor cables. In other words, at the front and the back of the platform for the drills 7 are respectively mounted the hydraulic drill 5 and the hydraulic drill 6, of which each comprises a high-torque hydraulic motor, a telescopic part of the drill, a turning part of the drill, a cylinder for integrally lifting the drill, a part for integrally moving the drill forward and backward or toward the left and/or the right and a hydraulic operating system of the drill and the like.

Figure 4:
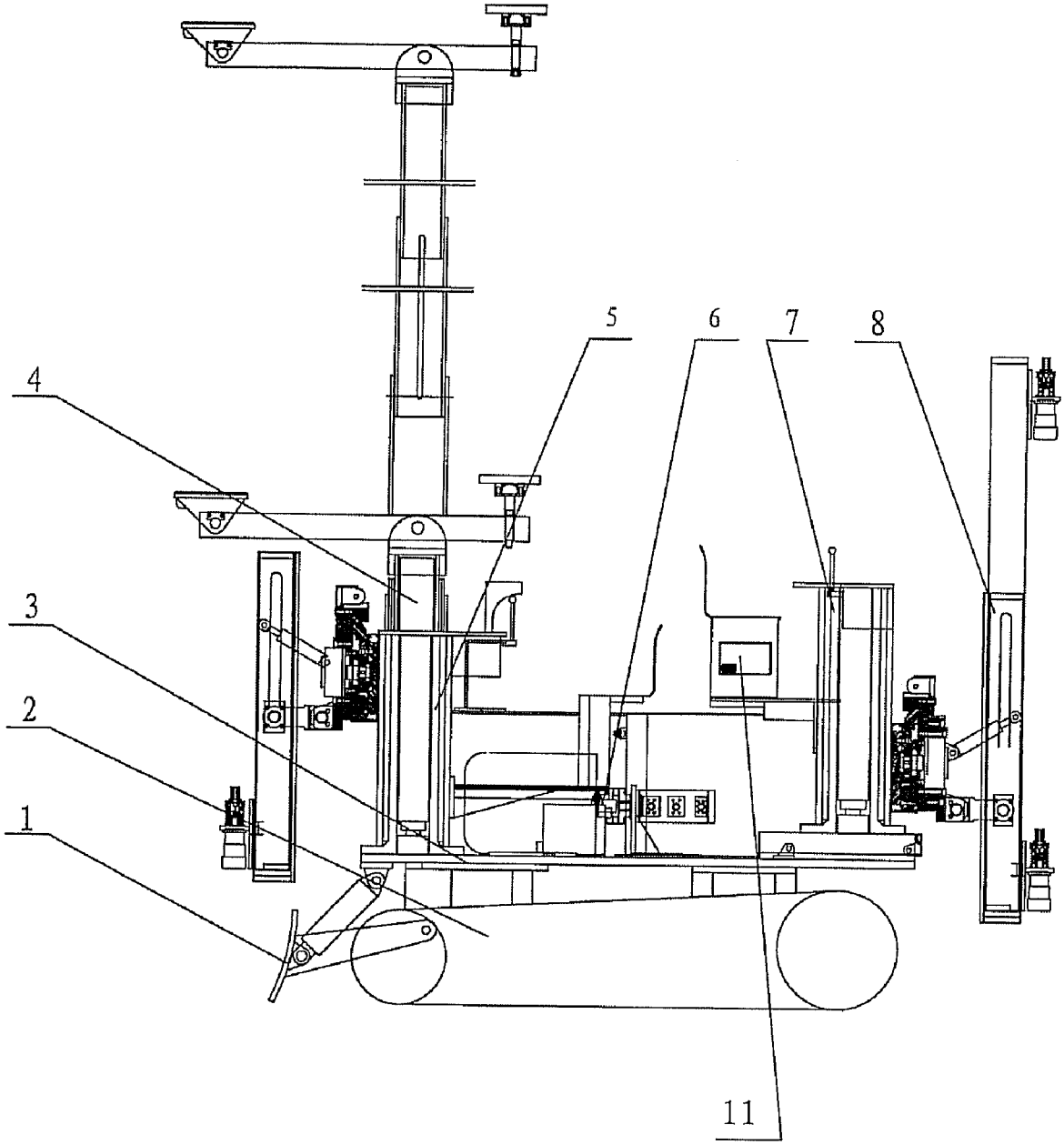
FIG. 4 is a front view of another embodiment of the crawler-type and height adjustable drilling machine for setting roof and/or side wall anchor bolts and anchor cables according to the present invention.

FIG. 4 shows another embodiment of the crawler-type and height adjustable drilling machine for securing roof and side wall bolts and anchor cables according to the present invention. Compared with the previous embodiment, the distance between the two drills is increased and the height at which the side wall anchor bolts is built is lowered, so that the operation is more convenient. Besides, a support is added between the columns and the coal pushing shovel to make the machine more stable and to increase the push force of the coal pushing shovel.

The improvements of the hydraulic drill part of the crawler-type and height adjustable drilling machine for setting roof and side wall anchor bolts and anchor cables and side wall according to the present invention are as the following:

(1) Double-columns 11 are used, on which the slipway 12 for the part that is movable to left and/or right is arranged so as to save the space of the platform for the drills and make the equipment structure to be more compact.

(2) In one of the double columns are the temporary support 3 and the lift cylinder which supports the connecting cross beam 4 on its top, preferably a cross beam with T-shaped cross section, which not only can increase the area of the top plate of the support, but also functions as a beam for supporting the steel bars when anchors and a net combined support, which is more convenient for working in situ.

(3) The whole hydraulic drill for setting side wall anchor bolts and anchor cables moves forward and backward driven by a cylinder on the platform which has in its longitudinal direction the slipways 10, on which seats one of the columns of the hydraulic drill.

The crawler-type and height adjustable drilling machine for setting roof and/or side wall anchor bolts and anchor cables according to the present invention is support equipment used for tunnels of continuous mining, continuous excavating and comprehensive excavating and can freely move in the tunnels by crawler. Preferably, two crawler-type and height adjustable drills for setting roof and/or side wall anchor bolts and anchor cables are used together, namely, one has the hydraulic drill for securing side wall anchor bolts and anchor cables at the left side wall of the platform for the drills while the other at the right side wall, and the two hydraulic drills rotates in opposite direction.

It is not difficult for those skilled in the art to understand that the basic technical solution of the present invention comprises not only all the embodiments described above and any combination thereof but also any technical solutions that one can directly get without any creative work after reading the description of the present invention.

The invention claimed is:

1. A crawler-type and height adjustable drilling machine for setting roof and/or side anchor bolts and anchor cables, comprising a crawler moving part (1), a temporary support, a cylinder for height adjusting (3), a cross beam (4), a hydraulic drill (5) for setting roof anchor bolts and anchor cables, a hydraulic drill (6) for setting side anchor bolts and anchor cables, a platform (7) for the drills, a hydraulic system and operation console (8), a crawler driving motor and slipways (10) for forward and backward movement of the drill for side anchor bolts and anchor cables, characterized in that a coal pushing shovel (2) is arranged in front of the crawler moving part and below the platform which supports at its front part the hydraulic drill for setting roof anchor bolts and anchor cables which can turn left or right; double columns (11) are provided on which a slipway (12) for left and right moving is mounted; the hydraulic drill for setting side anchor bolts and anchor cables is arranged at one side to of the central part of the platform for the drills and can turn toward one side; the platform for the drills is provided with the slipways (10) for moving forwardly and backwardly on which columns of the hydraulic drill (6) for setting side anchor bolts and anchor cables are arranged so that a cylinder mounted on the platform for the drills pushes the hydraulic drill (6) for setting side anchor bolts and anchor cables to move forward and backward.

2. The drilling machine according to claim 1, wherein the hydraulic drill for roof anchor bolts and anchor cables can turn left or right up to 30 degrees.

3. The drilling machine according to claim 2, wherein the hydraulic drill for side anchor bolts and anchor cables can turn up to 90 degrees.

4. The drilling machine according claim 3, wherein the coal pushing shovel (2) is connected to a rear region of the platform and also to bottom parts of the double columns.

5. The drilling machine according to claim 4, wherein the cross beam (4) is a steel beam with T-shaped cross section.

6. The drilling machine according claim 4, further comprising a second wherein two hydraulic drill for side anchor bolts and anchor cables, and said hydraulic drill for side anchor bolts and anchor cables and said second hydraulic drill are respectively arranged at the left side and the right side of the platform for the drills and can turn in opposite directions.

7. The drilling machine according to claim 3, wherein the cross beam (4) is a steel beam with T-shaped cross section.

8. The drilling machine according claim 3, further comprising a second wherein two hydraulic drill for side anchor bolts and anchor cables, and said hydraulic drill for side anchor bolts and anchor cables and said second hydraulic drill are respectively arranged at the left side and the right side of the platform for the drills and can turn in opposite directions.

9. The drilling machine according claim 2, wherein the coal pushing shovel (2) is connected to a rear region of the platform and also to bottom parts of the double columns.

10. The drilling machine according to claim 9, wherein the cross beam (4) is a steel beam with T-shaped cross section.

11. The drilling machine according to claim 2, wherein the cross beam (4) is a steel beam with T-shaped cross section.

12. The drilling machine according to claim 1, wherein the hydraulic drill for side anchor bolts and anchor cables can turn up to 90 degrees.

13. The drilling machine according claim 12, wherein the coal pushing shovel (2) is connected to a rear region of the platform and also to bottom parts of the double columns.

14. The drilling machine according to claim 13, wherein the cross beam (4) is a steel beam with T-shaped cross section.

15. The drilling machine according to claim 12, wherein the cross beam (4) is a steel beam with T-shaped cross section.

16. The drilling machine according to claim 1, wherein the coal pushing shovel (2) is connected to a rear region of the platform and also to bottom parts of the double columns.

17. The drilling machine according to claim 16, wherein the cross beam (4) is a steel beam with T-shaped cross section.

18. The drilling machine according to claim 1, wherein the cross beam (4) is a steel beam with T-shaped cross section.

19. The drilling machine according claim 18, further comprising a second hydraulic drill for side anchor bolts and anchor cables, and said hydraulic drill for side anchor bolts and anchor cables and said second hydraulic drill are respectively arranged at the left side and the right side of the platform for the drills and can turn in opposite directions.

20. The drilling machine according to claim 1, further comprising a second hydraulic drill for setting side anchor bolts and anchor cables, wherein said hydraulic drill for setting side anchor bolts and anchor bolts and said second hydraulic drill are respectively arranged at the left side and the right side of the platform for the drills and can turn in opposite directions.

* * * * *